US006824574B2

(12) United States Patent
O'Rear et al.

(10) Patent No.: US 6,824,574 B2
(45) Date of Patent: Nov. 30, 2004

(54) PROCESS FOR IMPROVING PRODUCTION OF FISCHER-TROPSCH DISTILLATE FUELS

(75) Inventors: Dennis J. O'Rear, Petaluma, CA (US); Thomas Van Harris, Solano, CA (US); Cong-Yan Chen, Kensington, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 134 days.

(21) Appl. No.: 10/267,444

(22) Filed: Oct. 9, 2002

(65) Prior Publication Data

US 2004/0068924 A1 Apr. 15, 2004

(51) Int. Cl.[7] ..... C10L 1/18

(52) U.S. Cl. ..... 44/448; 208/58; 518/700; 568/579; 568/697

(58) Field of Search ..... 44/448; 208/58; 518/700; 568/579, 697

(56) References Cited

U.S. PATENT DOCUMENTS

| | | | |
|---|---|---|---|
| 4,013,733 | A | 3/1977 | Rausch |
| 4,101,593 | A | 7/1978 | Hayes et al. |
| 4,148,833 | A | 4/1979 | Antos |
| 4,182,914 | A | 1/1980 | Imaizumi |
| 4,260,841 | A | 4/1981 | Holland et al. |
| 4,352,945 | A | 10/1982 | Bezman |
| 4,357,147 | A | 11/1982 | Bezman |
| 4,374,647 | A | 2/1983 | Bezman |
| 4,398,050 | A | 8/1983 | Hofstadt et al. |

(List continued on next page.)

FOREIGN PATENT DOCUMENTS

| | | | |
|---|---|---|---|
| DE | 198 25 295 | A1 | 9/1999 |
| GB | 600367 | | 4/1948 |
| WO | WO-97/14769 | A1 | 4/1997 |
| WO | WO-99/21943 | A1 | 5/1999 |
| WO | WO-0011116 | | 3/2000 |
| WO | WO-0011117 | | 3/2000 |
| WO | WO00/29515 | A3 | 5/2000 |
| WO | WO-01/46347 | A1 | 6/2001 |
| WO | WO-01/46348 | A1 | 6/2001 |

OTHER PUBLICATIONS

Marchionna, M., et al., "From Natural gas to Oxygenates for Cleaner Diesel Fuels," *6th Natural Gas Conversion Symposium, Girwood, Alaska*, Jun. 17–22, 2001, Elsevier Science, B.V.

(List continued on next page.)

*Primary Examiner*—Cephia D. Toomer
(74) *Attorney, Agent, or Firm*—Burns, Doane, Swecker & Mathis, L.L.P.

(57) ABSTRACT

Olefins and alcohols present in Fischer-Tropsch light naphthas are converted to dialkyl ethers of the formula: R—O—R' where R and R' are each primarily non-tertiary alkyl groups of more than four carbon atoms, via hydration of the olefins to alcohols followed by dehydration of the alcohols. Ethers may also form by direct reaction of olefins and alcohols. The ethers are separated from the remaining paraffins in the naphtha by distillation and added in an amount of 1–25 wt. % to paraffinic mid-distillate fuel components obtained by hydrotreating a Fischer-Tropsch product. The properties of the distillate fuel components such as lubricity and seal swell are improved by the dialkyl ethers. The removal of olefins and alcohols from the naphthas reduces refining and lead to a more salable product.

15 Claims, 2 Drawing Sheets

U.S. PATENT DOCUMENTS

| | | | | | |
|---|---|---|---|---|---|
| 4,398,922 | A | | 8/1983 | Bezman | |
| 4,403,999 | A | | 9/1983 | Bezman | |
| 4,405,822 | A | | 9/1983 | Bezman | |
| 4,428,753 | A | | 1/1984 | Bezman | |
| 4,444,909 | A | * | 4/1984 | Chang et al. | 518/716 |
| 4,523,045 | A | | 6/1985 | Vora | |
| 4,523,048 | A | | 6/1985 | Vora | |
| 4,544,792 | A | | 10/1985 | Smith et al. | |
| 4,547,601 | A | | 10/1985 | Holland et al. | |
| 4,605,680 | A | * | 8/1986 | Beuther et al. | 518/715 |
| 4,962,239 | A | | 10/1990 | Bell et al. | |
| 5,012,021 | A | | 4/1991 | Vora et al. | |
| 5,100,534 | A | | 3/1992 | Le et al. | |
| 5,198,597 | A | | 3/1993 | O'Young et al. | |
| 5,231,233 | A | | 7/1993 | Le et al. | |
| 5,258,560 | A | | 11/1993 | Marker | |
| 5,405,814 | A | | 4/1995 | Beech, Jr. et al. | |
| 5,520,710 | A | | 5/1996 | Olah | |
| 5,689,031 | A | | 11/1997 | Berlowitz et al. | |
| 5,741,759 | A | | 4/1998 | Gee et al. | |
| 5,766,274 | A | | 6/1998 | Wittenbrink et al. | |
| 5,814,109 | A | | 9/1998 | Cook et al. | |
| 5,866,746 | A | | 2/1999 | Didillion et al. | |
| 5,965,783 | A | | 10/1999 | Gee et al. | |
| 6,056,793 | A | | 5/2000 | Suppes | |
| 6,087,544 | A | | 7/2000 | Wittenbrink et al. | |
| 6,392,108 | B1 | | 5/2002 | O'Rear | |

OTHER PUBLICATIONS

Marchionna, M., et al., "High Cetane Ethers For the Reformulation of Diesel Fuels," *16th Proceeding of the World Petroleum Congress*, 2000, vol. 3, pp. 38–45.

Search Report from GB 0321963.1 dated Feb. 26, 2004.

* cited by examiner

PROCESS FOR IMPROVING PRODUCTION OF FISCHER-TROPSCH DISTILLATE FUELS

The present invention relates generally to the processing of Fischer-Tropsch products and more particularly to a method for converting olefins and alcohols present in Fischer-Tropsch naphthas into ethers and blending the ethers into mid-distillate fuel components thereby improving the properties of the fuels.

BACKGROUND OF THE INVENTION

The increased demand for middle distillate transportation fuels such as jet fuel and diesel fuel has provided the incentive for expanding the production of these fuels by converting natural gas, coal and heavy petroleum fractions. A known technique for processing these resources into distillate fuels involves a Fischer-Tropsch reaction whereby a synthesis gas essentially containing $H_2$ and CO is converted into highly linear hydrocarbonaceous products containing paraffins, olefins and oxygenates such as acids and alcohols. The linear paraffins are converted into isoparaffinic distillate fuel components using known procedures such as hydrotreating, hydrocracking and hydroisomerization dewaxing. The isoparaffinic distillate fuels have excellent burning properties (high jet smoke points and high diesel cetane numbers) but are essentially free of oxygenates, aromatics and compounds containing hetero atoms and as a result, suffer from low lubricity, poor seal swell and low density.

The Fischer-Tropsch synthesis of hydrocarbonaceous products also provides a significant quantity of by-product naphthas. The naphthas are composed of low molecular weight linear hydrocarbons which are too volatile for incorporation into distillate transportation fuels. This naphtha stream is less valuable than distillate fuels but it is not possible to vary the reaction conditions to selectively eliminate the production of naphtha and increase the production of distillate transportation fuels. Furthermore, the naphtha often contains high levels of olefins and oxygenates which makes it unsuitable for use in gasoline or as a petrochemical plant feed. Accordingly, in conventional practice, the naphtha is refined to reduce the content of olefins and oxygenates in order to provide a salable naphtha.

Various solutions have been proposed to improve the lubricity of distillate fuels. The use of alcohols derived from a Fischer-Tropsch process in diesel fuels to control lubricity is described in U.S. Pat. No. 5,814,109. The production of mid-distillate fuels that contain oxygen (not oxygenates) with a high cetane number and good lubricity is described in European Patent Application EP 885275A1. U.S. Pat. No. 5,689,031 discloses the production of clean distillate fuel with improved lubricity by processing a Fischer-Tropsch wax. U.S. Pat. No. 6,087,544 discloses a process for producing distillate fuels having high lubricity and low sulfur levels by fractionating a distillate feedstream into a light fraction of relatively low lubricity which contains about 50 to 100 wppm of sulfur and a heavy fraction having a relatively high lubricity, hydrotreating the light fraction to remove substantially all of the sulfur and blending with the heavy fraction. U.S. Pat. No. 5,766,274 discloses producing a clean distillate useful as a jet fuel or jet blending stock with improved lubricity by separating a Fischer-Tropsch wax into heavier and lighter fractions, hydroisomerizing the heavier fraction and that portion of the light fraction boiling above about 475° F., and blending. The isomerized product with the untreated portion of the lighter fraction. FR-0016538 describes the use of glycerol monoesters as lubricity improvers. SAE Paper 1999-01-1512 describes the use of conventional additives to improve the lubricity of a Fischer-Tropsch diesel fuel. The diesel fuel described in this report was prepared by a high temperature process followed by oligomerization. Diesel fuels made by this route will contain some aromatics and highly branched isoparaffins.

U.S. Pat. No. 4,547,601 describes the separation of water soluble oxygenates of a Fischer-Tropsch synthesis product from water and acids and subsequent conversion by a dehydration catalyst and a special zeolite catalyst to a middle distillate. See also related U.S. Pat. No. 4,260,841. U.S. Pat. No. 4,544,792 describes a process for converting olefinic feedstock, such as a Synthol olefinic liquid product of a Fischer-Tropsch synthesis, to distillate hydrocarbons by contacting the feedstock at elevated temperature and pressure with an acid zeolite conversion catalyst to oligomerize olefins and convert oxygenated hydrocarbons contained in said light oil. Temperatures up to 325° C. and $H_2$ are used thereby providing an effluent containing heavy distillate range hydrocarbon, light gas and byproduct water. Alcohols and oxygenates in the feed are removed prior to oligomerization by water washing. U.S. Pat. No. 4,398,050 describes the formation of methanol and higher alcohols with dehydration of the higher alcohols to make ethylene and propylene.

European Patent Application EP 1027409A1 describes the addition of ethers to compression ignition fuels. These ethers are described as being preferably those used in gasoline (which would include ethers with a high content of tertiary alkyl groups), di-ethyl ether, or those having less than 10 carbon atoms.

In a recent publication titled "From Natural Gas to Oxygenates for Cleaner Diesel Fuels," presented at the 6th Natural Gas Conversion Symposium, Girdwood, Alaska—Jun. 17-22, 2001, researchers from Snamprogetti S.p.A.—Milan, Italy described the preparation and use of di-n-pentyl and methyl-octyl ethers for use as a diesel fuel. The di-n-pentyl ether is prepared from butenes by a complex chemical process involving hydroformylation, and the methyl-octyl ether is prepared by a complex chemical process involving telomerization and selective hydrogenation.

U.S. Pat. No. 5,520,710 describes the use of certain symmetrical or unsymmetrical dialkyl ethers, dicycloalkyl ethers, or alkyl-cycloalkyl (polycycloalkyl) ethers containing a total of 2 to 24 carbon atoms, in combination with alkyl or dialkyl peroxides having one to 12 carbon atoms in each alkyl group, as supplements to diesel fuels to provide a cleaner burning fuel with significantly decreased hydrocarbon, carbon monoxide and particulate matter emissions. The supplements also significantly enhance the cetane number of the fuel and impart other desirable properties to the fuel, such as lowered pour and cloud points.

WO 99/21943 describes the blending of ethers with Fischer Tropsch diesel fuel. However, these ethers are described as having a carbon number of less than 10, commonly used in gasoline (methyl tertiary amyl ether or methyl tertiary butyl ether), and diethyl ether.

WO 01/46347 A1 discloses significantly improved reduced particulate emission performance of exhausts of vehicles powered by fuel combustion both at high and low loads by adding oxygenates or other hydrocarbon components in a diesel fuel composition comprising a major amount of a base fuel and a relatively minor amount of at least one chemical component other than that generated in a refinery process stream.

WO 01/46348 discloses a fuel composition comprising a base fuel having 50 ppm or less or sulfur, 10% or less of olefin, 10% or less of ester and at least 1 wt. % of oxygenate chosen from certain alcohols(s) and ketone(s) and having no other oxygen atom in its structure, with improved reduction of particulate emission without using further additives such as cyclohexane or peroxides or aromatic alcohol and with little to no increase in nitrogen oxide (NOx) emission at high engine loads.

It is an object of the invention to provide an improved process to prepare Fischer-Tropsch middle distillate fuels, specifically jet fuels and diesel fuels, having acceptable lubricity, seal swell and density.

It is another object of the invention to provide a procedure to increase the production of middle distillate Fischer-Tropsch fuels through processing of light Fischer-Tropsch naphthas.

These and other objects of the present invention will become apparent to the skilled artisan upon a review of the following description, the claims appended thereto, and the Figures of the drawings.

SUMMARY OF THE INVENTION

The invention is based on the discovery that the production of highly isoparaffinic mid-distillate transportation fuels can be increased by treating a light Fischer-Tropsch naphtha to convert the olefins and alcohols present therein into dialkyl ethers, adding about 1 to 25% by weight of the ethers to highly paraffinic mid-distillate fuel fractions (i.e., those containing at least 70% by weight isoparaffins) obtained by a Fischer-Tropsch synthesis to improve lubricity and other properties, and recovering the olefin- and alcohol-reduced naphtha.

DETAILED DESCRIPTION OF THE INVENTION

Figure 1:
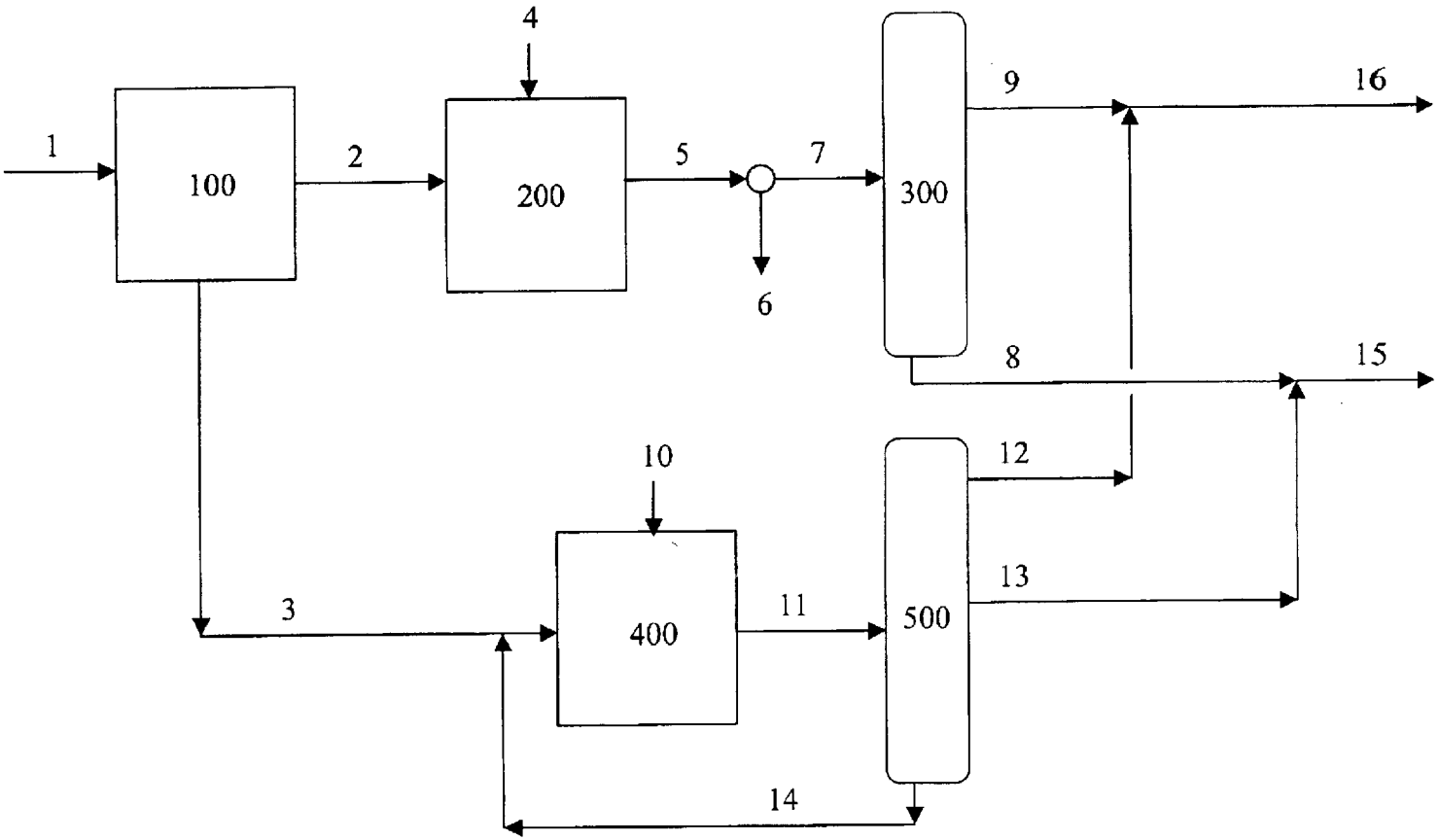
FIG. 1 is a schematic flow diagram of one embodiment of the invention.

We have discovered that middle distillate fuel boiling range ethers can be prepared from lighter Fischer-Tropsch naphtha by etherification and hydration reactions and the ethers subsequently added to middle distillate fuel components recovered from the Fischer-Tropsch synthesis. By middle distillate fuels, we mean that fraction which boils in a range of about 250° F. to about 700° F. as measured by the 5% and 95% points, respectively, from an ASTM D-2887 simulated distillation. These esterification and hydration reactions are well known, and have been used to prepare lighter ethers, such as DIPE (Di-isopropyl ether). The previous work has focused on the production of ethers which are more volatile than the starting alcohol or olefin. In contrast, this invention converts olefins and alcohols to dialkyl ethers which are higher boiling than the feedstock olefins and alcohols.

Boiling points of various alkyl alcohols and dialkyl ethers are shown in the following table.

TABLE 1

| Carbon No. | Species | Alcohol | Boiling Point, ° C. | Ether | Boiling Point, ° C. |
|---|---|---|---|---|---|
| 1 | Methyl | Methanol | 39 | Di-methylether | −25 |
| 2 | Ethyl | Ethanol | 78 | Di-ethylether | 35 |
| 3 | Propyl | n-Propanol | 97 | Di-n-propylether | 91 |
| | | i-Propanol | 87 | Di-i-propylether | 69 |
| 4 | Butyl | 1-Butanol | 117 | Di-n-butylether | 142 |
| | | 2-Butanol | 99 | Di-2-butylether | 120 |
| 5 | Pentyl | 1-Pentanol | 137 | Di-1-pentylether | 190 |
| | | 2-Pentanol | 118 | Di-2-pentylether | 172 |
| 6 | Hexyl | 1-Hexanol | 158 | Di-1-hexylether | 223 |
| 7 | Heptyl | 1-Heptanol | 177 | Di-1-heptylether | 258 |
| 8 | Octyl | 1-Octanol | 194 | Di-1-octylether | 286 |

Distillate transportation fuels (diesel and jet fuels) containing dialkyl ethers obtained according to the invention have several desired physical properties: improved lubricity, improved seal swelling, good cetane numbers and good smoke points and good environmental properties (low water solubility and rapid biodegradability). By synthesizing ethers from Fischer-Tropsch lighter naphtha streams and blending them with Fischer-Tropsch transportation fuel components, the process of the invention increases the yield of desired distillate transportation fuel, and decreases the amount of refining that must be done to convert the naphtha into a salable product. Furthermore, the distillate fuels of this invention can be used as a distillate fuel blend component and blended with other distillate fuels components to form a salable distillate fuel. A salable distillate fuel is a jet or diesel fuel that meets all the applicable specifications for sale of that product in the country of sale. A distillate fuel blend component (either the product of this invention or other blend streams) does not necessarily need to meet all specifications, as when the blend is made, deficiencies in one can be compensated by properties of the other.

As shown above, alcohols comprised of more than four carbon numbers form ethers which are higher boiling than the corresponding alcohol. The same is true for the relationship between the boiling point of the ether and the olefin. This permits a process in which the dialkyl ether can be formed from a naphtha that contains olefins, alcohols, and unreactive paraffins. The product ethers can then be separated from the unreactive paraffins by simple distillation. Also, the ether from alcohols and olefins with four carbons have boiling points of 120° C. and higher. This puts them into the boiling range of distillate fuels.

The conversion of light olefins into ethers uses an acid catalyst and water. The first step is hydration of the olefin to form an alcohol also over an acidic catalyst. This reaction consumes water:

$$R—CH{=}CH_2+H_2O \rightarrow R—CHOH—CH_3$$

the next step is the dehydration of the alcohol to form an ether and generate water.

$$2R—CHOH—CH_3 \rightarrow R—CH(CH_3)—O—CH(CH_3)—R+H_2O$$

Olefins and alcohols can also react directly to form an ether. This reaction neither uses nor produces water and is often referred to as condensation:

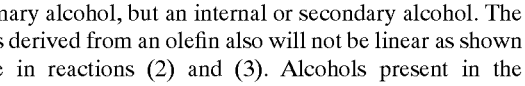

$$R—CH{=}CH_2+R'—CHOH—CH_3 \rightarrow R—CH(CH_3)—O—CH(CH_3)—R'$$

As shown above in reaction (1), the hydrated olefin is not a primary alcohol, but an internal or secondary alcohol. The ethers derived from an olefin also will not be linear as shown above in reactions (2) and (3). Alcohols present in the Fischer-Tropsch product are mostly primary alcohols. While it depends somewhat on the conditions and catalysts used in the dehydration step, the ethers derived from primary alcohols will likely be linear. So when a mixture of olefins and primary alcohols are present in a Fischer-Tropsch naphtha, the ethers obtained therefrom will be a mixture of primarily linear and branched structures of the formula:

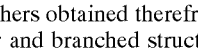

$$R—O—R'$$

where R and R' are each primarily non-tertiary alkyl groups of at least four carbon atoms. The concentration of primary alkyl groups in both R and R' will be between 10 and 90%, and the concentration of secondary alkyl groups in both R and R' will be between 10 and 90%. Preferably these concentrations will be between 25 and 75%. There will be small amounts of tertiary alkyl groups in R and R' due to minor amounts of skeletal isomerization of the olefin during the ether formation, but the proportion of tertiary R and R' structures relative to non-tertiary (primary and secondary) structures should be small, that is <20%, preferably <10%, more preferably <5%, and most preferably <2%. Accordingly, "primarily non-tertiary alky groups" as used herein refers to alkyl groups wherein the proportion of tertiary alkyl structures relative to non-tertiary (primary and secondary) alkyl structures is <20%, preferably <10%, more preferably <5%, and most preferably <2%.

For purposes of this application, linear dialkyl ethers are ethers derived from linear olefins and linear alkyl alcohols. They will consist of primary and secondary alkyl groups attached to the oxygen in the ether but will not contain significant amounts of tertiary alkyl groups. Since the ethers have higher boiling points then the corresponding alcohols, they can be readily separated from the remaining unreacted paraffins in the naphtha by distillation.

Water may or may not be needed to convert the initial mixture to ethers. If there is an excess of olefins relative to alcohols, water should be added. If there is an excess of alcohols relative to olefins water addition will not be needed since water will be formed. Fischer-Tropsch naphthas contain a mixture of both olefins and alcohols. The need for water, and the amount of water to be added, depends on the analysis of the naphtha. The stoichiometric reaction for conversion of a pure olefin into an ether requires about 0.5 moles of water per mole of olefin. Thus for a pure olefin, this amount of water is generally preferred from a stoichiometric standpoint. However, to minimize the olefin oligomerization reaction, slightly more water should be added. The desired effective ratio of water to olefin should be about 0.1 to 3, preferably about 0.25 to 1.0, and most preferably about 0.5 to 0.6.

If alcohols and ethers are present in the feedstock, various equilibrium relationships must also be considered. A mole of alcohol can dehydrate to form a mole of water and a mole of olefin. A mole of ether can dehydrate to form a mole of water and two moles of olefin. Thus, the effective amount of water in the reactor can be calculated as moles of water added to the feedstock plus moles of alcohol in the feedstock plus moles of ether in the feedstock and the effective amount of olefins in the reactor can be calculated as moles of olefin in the feedstock plus moles of alcohol in the feedstock plus two times the moles of ether in the feedstock. All quantities are moles of species per mole of feedstock. These definitions of the effective amounts of water and olefins in the reactor can be used with the preferred ranges of the effective ratio of water to olefin to determine how much, if any, water must be added to the feedstock. In equation form, $$\text{Effective ratio of water to olefin}=(\text{Water}+\text{Ether}+\text{Alcohol})/(\text{Olefin}+\text{Alcohol}+(2\times\text{Ether}))$$

where all quantities are moles of species per mole of feedstock, "Ether," "Alcohol" and "Olefin" refer to moles in the feedstock, and "Water" refers to moles added to the feedstock.

The preferred ranges of effective ratio of water to olefin are about 0.1 to 3, more preferably about 0.25 to 1.0, and most preferably about 0.5 to 0.6. This value can be used to determine how much, if any, additional water must be added to the feedstock. Because water is both added to the olefins and removed during the conversion of the olefin to the ethers, a water-to-reactive hydrocarbon ratio exists for a single step reaction that will optimize the production of the ethers. If too little water is added, unreacted olefins will predominate, or react by oligomerization. If too much water is added, alcohol formation will predominate rather than the desired ethers.

Rather than using a single step reaction, a two-step reaction can be used. For example, an excess of water can be used in the first step to convert the majority of the olefins into alcohols. Then in a second step the alcohols can be reacted under different conditions and/or with a different catalyst to selectively produce ethers by dehydration of the alcohols versus dehydration to regenerate olefins.

The hydration of olefins to alcohols and the dehydration of alcohols to ethers has been well known for many decades (see, for example, Morrison and Boyd, Organic Chemistry 2nd Edition, 1969, pages 561–562). An acid catalyst is required. The acid catalyst should be regenerable and not affected by the presence of water. The preferred acid catalysts fall into two types: solid acid catalysts (zeolites, acidic clays, silica aluminas, etc.) and resin catalysts. Acid catalysts such as aluminum chloride, sulfuric acid, phosphoric acid, hydrofluoric acid, and other bulk acids are not preferred because they either react with water, or are diluted by it.

Zeolites are very rugged and can be regenerated by use of oxidation. The preferred zeolites contain at least some 10-ring or larger pores. Preferred zeolites for alcohol condensation to ethers contain 12-ring or larger pores. Preferred zeolites for olefin hydration to alcohols contain 10-ring or larger pores. Examples of zeolites that have contain 12-ring or larger pores include Beta, Y, L, Mordenite, MCM-22, MCM-36, ZSM-12, SSZ-25, SSZ-26, and SSZ-31. Examples of zeolite that have 10-ring or larger pores include ZSM-5, ZMS-11, ZSM-22, ZSM-23, ZSM-35, Ferrierite, SSZ-20, SSZ-32, and Theta-1. Examples of zeolites that contain both 10-ring and 12-ring pores include SSZ-25, SSZ-26, and MCM-22. The use and selection of zeolites permits the olefin hydration to proceed rapidly, and secondary ethers to form. However, the concentration of acidic sites in zeolites is moderate, and they require the use of temperatures above 125 to 600° F. In contrast, resin catalysts have a large number of acidic sites and can be operated at comparatively lower temperatures (150 to 350° F.). However, the resin catalysts are not as rugged, and cannot be regenerated by oxidation. Either type of acid catalyst may be used, but the solid acid catalysts, especially zeolites, are preferred.

Examples of several types of catalysts which can be employed in the invention are disclosed in the U.S. patents disclosed herein, the disclosures of which are incorporated in their entirety.

Catalysts with Solid Acid (Zeolites)

The following U.S. patents teach conversions using zeolite catalysts. U.S. Pat. No. 5,405,814 discloses the conversion of light olefins into a mixture of alcohols. U.S. Pat. No. 4,962,239 discloses the preparation of ethers from alcohols and olefins. U.S. Pat. No. 5,231,233 discloses the hydration of light olefins to alcohols and/or ethers. The above patents use a fixed bed reactor in which all the reagents are in the liquid phase. U.S. Pat. No. 5,258,560 describes the use of a catalytic distillation reactor for the synthesis of ethers from alcohols and olefins.

The broad and preferred conditions for use with solid acid catalysts are shown in the following table.

TABLE 2

| | Olefin hydration to alcohols | | Alcohol dehydration to ethers and combined hydration of olefins to ethers | |
|---|---|---|---|---|
| | Broad | Preferred | Broad | Preferred |
| Temperature, ° F. | 125–600 | 300–400 | 125–600 | 300–400 |
| Pressure, psig | >75 | 250–2000 | >75 | 250–2000 |
| LHSV, $hr^{-1}$ | >0.1 | 0.5–2.0 | >0.1 | 0.5–2.0 |
| Eff. Water/Olefin | >1 | >2 | 0.1–3 | 0.25–1 |

Preferably, the pressure should be sufficient to maintain all the reactants in the liquid phase under reaction conditions. The LHSV is expressed on the basis of the sum of the rates of the reactive olefin, alcohols and water, and does not include paraffins. For alcohol dehydration to ethers and combined hydration of olefins and alcohol mixtures to ethers, the most preferred effective ratio of water to olefin is about 0.5 to 0.6.

Catalysis with Resin Catalysts

U.S. Pat. No. 4,182,914, discloses preparing di-isopropyl ether from iso-propyl alcohol and propylene in a series of operations employing a strongly acidic cation exchange resin as catalyst. Additional patents relating to the synthesis of alcohols and dehydration of alcohols to ethers using resin catalysts are U.S. Pat. No. 4,428,753 (continuous extractive blending process); U.S. Pat. No. 4,405,822 (diisopropyl ether hydration in isopropanol production); U.S. Pat. No. 4,403,999 (process for producing oxygenated fuels); U.S. Pat. No. 4,398,922 (extractive blending process); U.S. Pat. No. 4,374,647 (oxygenated fuel dehydration); U.S. Pat. No. 4,357,147 (diisopropyl ether reversion and oligomerization in isopropanol production); and U.S. Pat. No. 4,352,945 (diisopropyl ether reversion in isopropanol production).

The broad and preferred conditions for use with resin catalysts are shown in Table 3.

TABLE 3

| | Olefin hydration to alcohols | | Alcohol dehydration to ethers and combined hydration of olefins to ethers | |
|---|---|---|---|---|
| | Broad | Preferred | Broad | Preferred |
| Temperature, ° F. | 150–350 | 200–275 | 150–350 | 200–275 |
| Pressure, psig | >250 | >1250 | >250 | >1250 |
| LHSV, $hr^{-1}$ | >0.1 | 0.5–2.0 | >0.1 | 0.5–2.0 |
| Eff. Water/Olefin | >5 | >10 | 0.1–3 | 0.25–1 |

The terms are defined as above. For alcohol dehydration to ethers and combined hydration of olefins and alcohol mixtures to ethers, the most preferred effective ratio of water to olefin is about 0.5 to 0.6.

The catalysts used for olefin hydration to alcohols and subsequent conversion of alcohols to ethers can differ. The most preferred catalyst for conversion of olefins to alcohols is a resin catalyst. The most preferred catalyst for conversion of alcohols to ethers is a zeolite, preferably a zeolite that contains 10-ring pores, and most preferably a zeolite that contains non-intersecting 10-ring pores aligned along one crystal dimension.

During the preparation of the dialkyl ethers, traces of impurities, such as olefins, may be incorporated into the product. These impurities can form due to oligomerization of naphtha boiling range olefins or by dehydration and condensation of the ether. Traces of impurities of this type can cause the product to have insufficient stability. If necessary, these olefins can be hydrogenated to form inert paraffins without converting of the ethers. Examples of catalysts and process conditions to conduct this selective hydrogenation of olefins are well known and can be found in the following publications: Engelhard Catalysts and Precious Metal Chemicals Catalog, 1985, Catalysts for Allylic and Vinylic Systems (page 203), Catalysts for Phenols to Cyclohexanols (page 205), and references cited therein (available from Engelhard Corporation, Specialty Chemicals Division); Rylander "Catalytic Hydrogenation over Platinum Metals, Academic Press, New York, 1967 pages 59–120; Jardine, Prog. Inorg. Chem. 28, 63–202 (1981); Hannon, Parsons, Cooke, Gupta, and Schoolenberg, J. Org. Chem. 34, 3684 (1969). In general Rhodium and/or Ruthenium catalysts are preferred, although Palladium supported on an inert material (preferably carbon) can also be used.

Ethers also have the potential to form peroxides. Peroxides can attack gaskets in the fuel system, and can also accelerate further premature oxidation of the fuel during storage. The ether-Fischer-Tropsch blended distillate fuel can be stabilized against the formation of peroxides by the addition of anti-oxidant, detergents and/or dispersant additives. Additives of this type are well known in the field.

Peroxide formation can also be inhibited by blending with a sulfur-containing petroleum-derived feedstock. Examples of this approach for Fischer-Tropsch diesel fuels that do not contain ethers are described by Berlowitz and Simon of Exxon Research and Engineering Company in World Patent Application Nos. WO 00/11116A1 and WO 00/11117A1. In these, a Fischer-Tropsch derived diesel fuel is blended with high-boiling sulfur-containing streams, derived from gas field condensate or hydrotreated streams. In order to control the formation of peroxides by adding a sulfur-containing stream, the sulfur content of the blended distillate fuel should be at least 1 ppm by weight. Preferably it should be between 1 and 100 ppm by weight as this will both provide protection from peroxides and not cause excessive sulfur emissions when combusted. Most preferably, the blend contains between 1 and 10 ppm sulfur.

Another example of inhibiting peroxide formation is described in U.S. Pat. No. 6,392,108. U.S. Pat. No. 6,392,108 discloses methods of inhibiting oxidation in Fischer Tropsch products, and antioxidants for use with Fischer Tropsch products. The antioxidants are preferably temporary antioxidants that may be removed after the period in which oxidation is expected by techniques such as simple distillation. The temporary antioxidants are typically sulfur-containing compounds generated from sweetening light hydrocarbon streams.

Peroxide content can be measured using procedures following ASTM D3703 with the exception that the Freon solvent can be replaced by isooctane. Tests confirmed that this substitution of solvents has no significant affect on the results.

It should be recognized that the total production of ethers will be limited by the proportion of olefins and alcohols in the naphtha stream. The above processes and chemistries will not convert paraffins in this stream. Optionally, if higher yields of ethers are desired, it is possible to dehydrogenate at least a portion of the paraffins in the naphtha to form additional olefins. Preferably, this step occurs on the paraffin-enriched portion of the naphtha after the reactive olefins and alcohols have been converted to ethers and removed.

Dehydrogenation processes known in the art generally have employed catalysts which include Group VIII noble metals, e.g., iron, cobalt, nickel, palladium, platinum, rhodium, ruthenium, osmium, and iridium, preferably on an oxide support. Less desirably, combinations of Group VIII non-noble and Group VIB metals or their oxides, e.g., chromium oxide, may also be used. Suitable catalyst supports include, for example, silica, silicalite, zeolites, molecular sieves, activated carbon alumina, silica-alumina, silica-magnesia, silica-thoria, silica-berylia, silica-titania, silica-aluminum-thora, silica-alumina-zirconia kaolin clays, montmorillonite clays and the like. In general, platinum on alumina or silicalite afford very good results in this reaction. Typically, the catalyst contains about from about 0.01 to 5 wt. %, preferably about 0.1 to 1 wt. % of the dehydrogenation metal (e.g., platinum). Combination metal catalysts such as those described in U.S. Pat. Nos. 4,013,733; 4,101,593 and 4,148,833, the contents of which are hereby incorporated by reference in their entirety, can also be used. The temperature at which paraffin dehydrogenation is normally carried out is in a range from about 350 to 650° C. (preferably from about 400 to 550° C.). The process is usually carried out at atmospheric pressure, although it is possible to operate at a pressure of several atmospheres, for example up to about 10 atmospheres. The paraffins are generally fed at a rate of from about 0.001 to 100 volumes (calculated as a liquid) per hour for each volume of catalyst. Moreover, since the dehydrogenation reaction takes place in the presence of hydrogen gas, it is convenient to maintain the molar ratio of hydrogen to linear paraffin in the feed mixture at a value of from about 1:1 to 50:1. To avoid formation of di-olefins and acetylene compounds, the concentration of olefins in the exit, relative to the paraffins is kept below about 75%, preferably below 40%. Dehydrogenation catalysts foul and must be regenerated frequently by oxidation.

The dehydrogenation catalysts can be fouled by oxygen impurities, so any remaining alcohols or ethers in the naphtha are preferably removed prior to dehydrogenation. (Oxygen is not as bad a poison as sulfur is for dehydrogenation catalysts, but there still may be an incentive to remove the traces of oxygenates.) The removal of these oxygenates can be done by dehydrogenation over an acidic catalyst, or by complete hydrogenation using hydrogen with a catalyst from the Groups VI and/or VIII of the periodic table, preferably Ni, Co, Mo, W, Pd, and/or Pt.

If di-olefins and acetylene compounds are formed in the dehydrogenation step they can be removed. Preferably, diolefins produced during the dehydrogenation are removed by known adsorption processes or selective hydrogenation processes that selectively hydrogenate di-olefins to mono-olefins without significantly hydrogenating mono-olefins. Suitable selective hydrogenation processes for hydrotreating di-olefins to mono-olefins without hydrogenating mono-olefins are, for example, described in U.S. Pat. No. 4,523,045 to Vora ("Process For Converting Paraffins To Olefins"); in U.S. Pat. No. 4,523,048 to Vora ("Process For The Selective Production of Alkylbenzenes"); and U.S. Pat. No. 5,012,021 to Vora, et al. ("Process For The Production of AlkylAromatic Hydrocarbons Using Solid Catalysts"). U.S. Pat. Nos. 4,523,045; 4,523,048; 5,012,021; 5,198,597; 5,741,759; 5,866,746; and 5,965,783 are hereby incorporated by reference in their entirety.

Illustrated Embodiments

FIG. 1 represents a single-step process for conversion of olefins and alcohols in a Fischer-Tropsch naphtha into a high lubricity distillate fuel blend component. With reference to FIG. 1, a synthesis gas (1) obtained from a methane-containing stream, a heavy petroleum fraction or coal or shale is fed to a Fischer-Tropsch reactor (100). A naphtha (2) containing olefins and alcohols is obtained along with a heavy product (3). The naphtha (2) boils between $C_4$ and 350° F. and the heavy product (3) boils above 350° F. Lighter products (not shown) are also made in the Fischer-Tropsch reactor.

The naphtha (2) is mixed with water (4) so that the effective ratio of water to olefin is 0.55 and fed to an ether synthesis reactor (200) that contains a zeolite catalyst and which operates at 350° F., 0.25 LHSV, and 1500 psig. From the effluent (5) is recovered unreacted water (6) by phase separation, and the resulting product (7) is forwarded to a distillation unit (300). An ether component (8) is obtained as well as a naphtha (9) that is depleted in olefins and alcohols.

The heavy product (3) is mixed with hydrogen (10) in a hydrotreating unit (400) and reacted over a hydrotreating-hydrocracking catalyst at 700° F., 1.0 LHSV, 1500 psig, and a per-pass conversion below 700° F. of 70%. The hydrotreating-hydrocracking catalyst contains nickel, tungsten, silica and alumina and is sulfided. The effluent (11) from the hydrotreating unit (400) is forwarded to a distillation unit (500) to obtain a naphtha (12), a paraffinic distillate fuel component (13), and an unconverted heavy product (14). The paraffinic distillate fuel component (13) is mixed with the ether component (8) to form a high lubricity distillate fuel blend component (15). The two naphtha streams (9 and 12) from the distillation units (300 and 500) are combined to form a salable naphtha (16). The unconverted heavy product (14) may be recycled to be combined with the heavy product (3), prior to hydrotreating in the hydrotreating unit (400).

Figure 2:
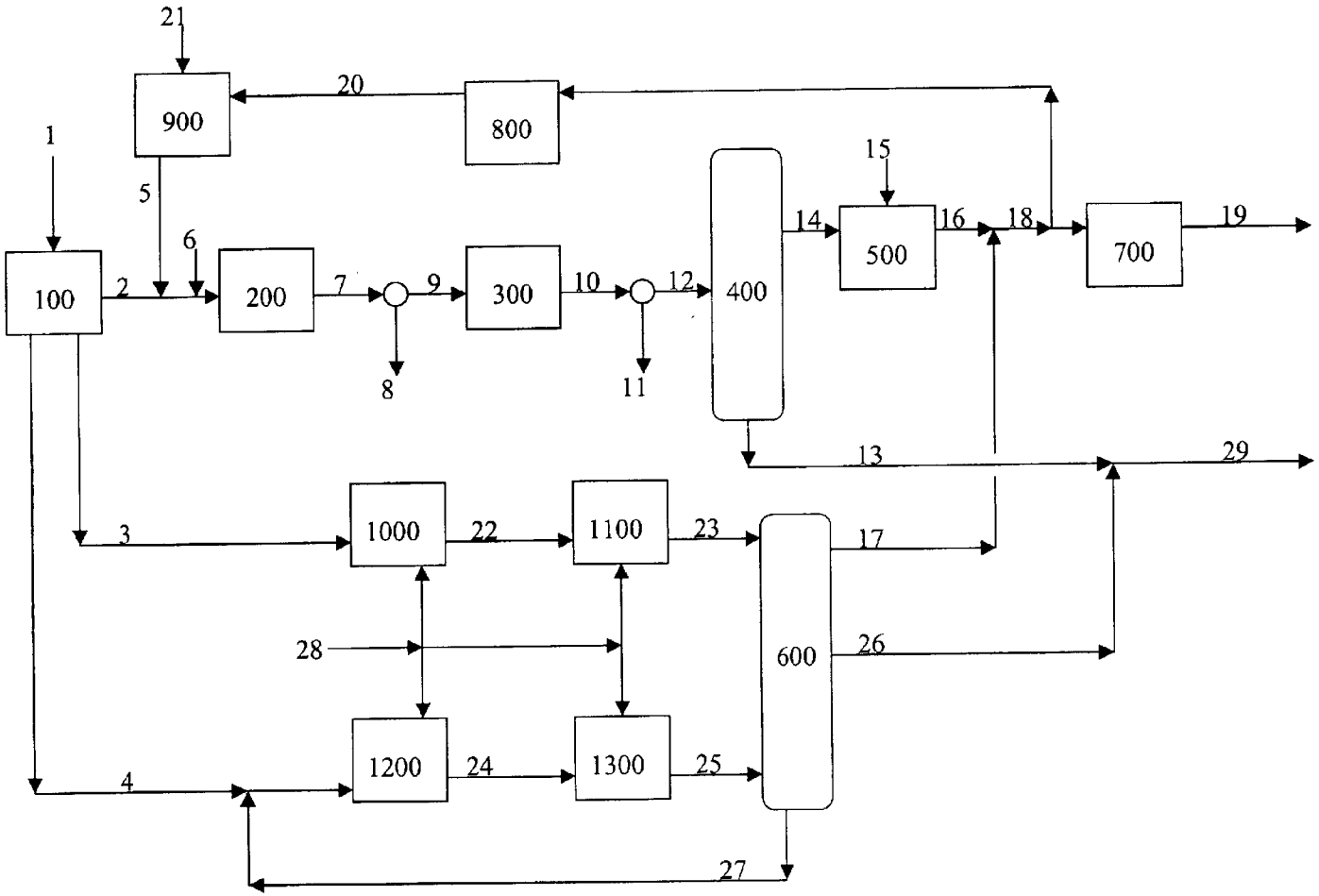
FIG. 2 is a schematic flow diagram of a second embodiment of the invention.

FIG. 2 represents a two-step process for conversion of olefins and alcohols in a Fischer-Tropsch naphtha into a high lubricity distillate fuel blend component. With reference to FIG. 2, a synthesis gas (1) obtained from a methane-containing stream, a heavy petroleum fraction, coal or the like is fed to a Fischer-Tropsch reactor (100). A naphtha (2) containing olefins and alcohols is obtained along with a raw distillate fuel product (3) and a heavy product (4). The naphtha (2) boils between $C_4$ and 350° F., the raw distillate fuel product (3) boils between 350° F. and 700° F., and the heavy product (4) boils above 700° F. Lighter products (not shown) are also made in the Fischer-Tropsch reactor.

The naphtha (2) is mixed with a stream rich in olefins (5) and water (6), such that the effective ratio of water to olefin is 10.0 and fed to an alcohol synthesis reactor (200) that contains a resin catalyst and operates at 250° F., 0.25 LHSV, and 1500 psig. From the effluent (7) is recovered unreacted water (8) by phase separation, and the resulting product (9) is fed to an ether synthesis reactor (300) with no added water. (Water is not needed in the ether synthesis reactor (300) because the majority of the olefins have been hydrated to form ethers.) The ether synthesis reactor (300) contains a 12-ring zeolite catalyst and which operates at 400° F., 0.25 LHSV, and 250 psig.

From the effluent (10) is recovered unreacted water (11) by phase separation, and the resulting product (12) is forwarded to a distillation unit (400). An ether component (13) is obtained as well as a naphtha (14) that is depleted in olefins and alcohols. The naphtha (14) is mixed with hydrogen (15) in a hydrotreating unit (500) and hydrotreated to remove remaining traces of olefins and alcohols. The effluent (16) is mixed with another naphtha (17) from distillation unit (600) that also contains low levels of olefins and alcohols. This purified naphtha (18) can then be optionally reformed in reforming unit (700) to make a salable naphtha (19) which can be used as a high octane gasoline blend component or as a feedstock for the preparation of benzene, toluene, or xylene. By-product $H_2$ (30) from the reforming unit (700) can be used elsewhere in the process. Alternatively, the purified naphtha (18) is dehydrogenated in dehydrogenation unit (800) to form additional olefins and traces of diolefins (20). The additional olefins and traces of diolefins are mixed with hydrogen (21) in a diolefin hydrogenation unit (900) to selectively hydrogenated the diolefins to leave a stream rich in olefins (5) which is mixed with the naphtha (2) from the Fischer-Tropsch reactor (100) and water (6) and fed to the alcohol synthesis reactor (200).

Meanwhile, the raw distillate fuel product (3) is hydrotreated in a hydrotreating unit (1000) to remove alcohol impurities using a sulfided nickel molybdenum on alumina catalyst at 500 psig, 1.5 LHSV, and 700° F. The hydrotreated distillate (22) is then processed in a selective hydrodewaxing reactor (1100) at 1000 psig, 1.0 LHSV and 700° F. to reduce the cloud point of the raw distillate fuel product (3). The effluent (23) from the selective hydrodewaxing reactor (1100) is fed to a distillation column (600).

The heavy product (4) is hydrotreated in hydrotreating unit (1200) to remove alcohol impurities using a sulfided nickel molybdenum on alumina catalyst at 1000 psig, 1.5 LHSV, and 700° F. The hydrotreated heavy product (24) is then processed in a hydrocracking reactor (1300) at 1500 psig, 1.5 LHSV, 750° F., a 700° F. per-pass conversion of 70% over a sulfided nickel, tungsten, silica, alumina catalyst. The effluent (25) from the hydrocracking reactor (1300) and the effluent (23) from the selective hydrodewaxing reactor (1100), which may be optionally combined, are fed to a distillation column (600) to obtain a naphtha (17) that contains very low levels of olefins and alcohols, a highly paraffinic distillate fuel blend component (26), and an unconverted heavy product (27). The unconverted heavy product (27) may be recycled to be combined with the heavy product (4), prior to hydrotreating in the hydrotreating unit (1200). In addition to the reactants, hydrogen (28) is fed to the hydrotreating unit (1000), the selective hydrodewaxing reactor (1100), the hydrotreating unit (1200), and the hydrocracking reactor (1300).

The paraffinic distillate fuel component (26) is mixed with the ether component (13) to form a high lubricity distillate fuel blend component (29). The properties of the high lubricity distillate fuel blend component (29) are: cetane number of at least 55, a sulfur content of 15 ppm by weight or less, a polycyclic aromatic content no greater than 1.5 weight percent, and a concentration of ethers greater than 1 wt. %, preferably greater than 5 wt. %, and most preferably greater than 10 wt. %. More preferably, the mixture also has less than 15 volume percent aromatics, a nitrogen content of less than 10 ppm by weight, a pour point of <−12° C., a cloud point of <−10° C., and an initial boiling point of 350° F. or greater. Most preferably, the high lubricity distillate fuel blend component (29) meets all specifications as described in ASTM D975-96a for a low sulfur no. 2-D fuel.

The invention will now be illustrated by the following examples which are intended to be merely exemplary and in no manner limiting.

EXAMPLE 1

Identification of Suitable Catalysts for Ether Synthesis from Alcohols

The following simple batch experiment was employed to identify catalysts useful for conversion of alcohols into ethers.

For each experiment, 1.0 g of catalyst was charged to a 25 mL stainless steel pressure batch reactor equipped with a magnetic stirring bar. The reactor was evacuated and backfilled with nitrogen several times. While under nitrogen, 5 mL of 1-butanol was added. The reactor was then heated with stirring for 18 hours at 200° C. Upon heating, the pressure rose to approximately 200–250 psig. At the end of the heating period, the reactor was cooled to room temperature and then to dry ice temperature. Through a rubber septum 5 mL of n-hexane was added. Next ~2 g of n-heptane was accurately weighed in to serve as an internal standard. The product was then removed from the reactor and analyzed by gas chromatography.

Samples of various acidic catalysts were evaluated in this batch test with the following results:

TABLE 4

| Experiment No. | Catalyst Identification | Zeolite Ring Aperture Size | Alpha Value | 1-Butanol conversion, % | Butene selectivity, % | Di-n-butyl ether selectivity, % |
|---|---|---|---|---|---|---|
| 1 | CBV-760 Y zeolite | 12 | 28 | 77.9 | 5.6 | 94.4 |
| 2 | CBV-9010 Y zeolite | 12 | 3 | 83.3 | 9.5 | 90.5 |
| 3 | $Al_2O_3$-bound SSZ-32 | 10 | ~300 | 44.6 | 55.2 | 44.8 |
| 4 | $Al_2O_3$-bound ZSM-5 | 10 | 300 | 91.8 | 43.6 | 56.4 |

The preferred catalysts for this application will have the highest possible values for 1-butanol conversion and selectivity for formation of di-n-butyl ether. The catalysts will have conversions and selectivities under conditions of this test equal to or greater than 50%, preferably equal to or greater than 75%, and most preferably equal to or greater than 90%.

EXAMPLE 2

Flow Micro Reactor Tests to Identify Catalysts Suitable for Conversion of Alcohols into Ethers A flow-type microunit was equipped with a stainless steel fixed bed reactor and an on-line GC. The catalysts studied here are as follows: Alumina-bound Al-SSZ-32, Alumina-bound Al-ZSM-5, Alumina base (Condea Chemie, as-provided by the supplier), and Alumina based (calcined in air at 950° F. for 4 hours).

The catalysts (0.24–0.26 g=4.0 cc each) were crushed to 24–60 mesh and, prior to the reaction, dehydrated in a N2 flow (200 cc/min) at 662° F. (350° C.) overnight.

The reactions were carried out in a down-flow mode at atmospheric pressure and 0.5/1.0 LHSV between 392 and 572° F. Only in one case (Al-SSZ-32) the reaction was carried out once at 240 psig. No carrier gas such as $H_2$, $N_2$ or He was used during the reaction.

The products were analyzed with an on-line GC using a HP-1 capillary column and a Flame Ionization Detector (FID). The FID Response Factors (RF) for 1-butanol, di-n-butyl ether and hydrocarbons were determined assuming hydrocarbon RF=1.

TABLE 5

| Component | Response Factor (RF) |
|---|---|
| 1-butanol | 1.4663 |
| di-n-butyl ether | 1.2626 |
| octane(as internal standard) | 1.0000 |

The response factors are defined so that:

$$W_1=W_{octane}\times(A_i/A_{octane})\times(RF_i/RF_{octane})$$

where $W_i$ stands for the weight of component i, Ai for the GC area of component i and $RF_1$ for the Response Factor of component i with $RF_{octane}=1$ for the internal standard octane.

TABLE 6

Results from 1-butanol dehydration over alumina bound Al-SSZ-32

| Temperature, ° F. | 482 | 482 | 482 | 392 | 410 | 410 |
|---|---|---|---|---|---|---|
| Pressure, psig | 0 | 0 | 0 | 0 | 0 | 240 |
| LHSV, $hr^{-1}$ | 0.5 | 1.0 | 2.0 | 1.0 | 1.0 | 1.0 |
| 1-Butanol Conversion, % | 100 | 100 | 100 | 7.7 | 24.8 | 17.9 |
| Selectivity, wt. % | | | | | | |
| 1-Butene | 13.3 | 15.2 | 15.2 | 19.1 | 21.0 | 7.8 |
| cis-2-Butene | 24.0 | 30.7 | 31.5 | 22.9 | 25.0 | 18.4 |
| trans-2-Butene | 40.4 | 50.4 | 51.5 | 38.5 | 43.2 | 31.3 |
| iso-Butene | 0.9 | 0.5 | 0.5 | 1.3 | 0.4 | 0.5 |
| Total Butenes | 78.6 | 96.8 | 98.7 | 81.8 | 89.6 | 58.0 |
| Di-butyl ethers | 0 | 0 | 0 | 16.9 | 10.1 | 16.8 |
| Oligomers | 21.4 | 3.2 | 1.3 | 1.3 | 0.4 | 25.1 |

These results show that the 1-dimensional 10-ring zeolite SSZ-32 can give conversions of 100% and selectivities to desired ethers are low. Higher space velocities can reduce the formation of oligomers. Higher pressures increase the selectivity to ethers, but also oligomers. Thus some experimentation in the process conditions are needed to achieve the desired selectivies.

TABLE 7

Results from 1-butanol dehydration over alumina bound Al-ZSM-5

| Temperature, ° F. | 482 | 392 | 392 | 410 |
|---|---|---|---|---|
| Pressure, psig | 0 | 0 | 0 | 0 |
| LHSV, $hr^{-1}$ | 0.5 | 0.5 | 1.0 | 1.0 |
| 1-Butanol Conversion, % | 100 | 35.9 | 22.8 | 35.4 |
| Selectivity, wt. % | | | | |
| 1-Butene | 11.9 | 13.1 | 17.5 | 13.6 |
| cis-2-Butene | 22.1 | 13.7 | 13.6 | 13.8 |
| trans-2-Butene | 36.3 | 20.6 | 21.1 | 20.3 |
| iso-Butene | 0.5 | 0.6 | 0.4 | 0.3 |
| Total Butenes | 70.8 | 48.0 | 52.6 | 48.0 |
| Di-butyl ethers | 0 | 50.4 | 45.6 | 50.6 |
| Oligomers | 29.2 | 1.7 | 1.8 | 1.4 |

In comparison to the 1-dimensional 10-ring zeolite SSZ-32, results from the 3-dimensional 10-ring zeolite ZSM-5 show better selectivities to the desired ethers and low selectivities to oligomers.

TABLE 8

Results from 1-butanol dehydration over alumina

| Temperature, ° F. | 482 | 482 | 572 |
|---|---|---|---|
| Pressure, psig | ~0 | ~0 | ~0 |
| LHSV, $hr^{-1}$ | 1.0 | 0.5 | 0.5 |
| 1-Butanol Conversion, % | 15.9 | 18.6 | 85.1 |
| Selectivity, wt. % | | | |
| 1-Butene | 8.8 | 11.7 | 79.1 |
| cis-2-Butene | 0.6 | 0.4 | 0.6 |
| trans-2-Butene | 0.6 | 0.4 | 2.0 |
| iso-Butene | 0 | 0 | 0.1 |
| Total Butenes | 10.0 | 12.5 | 81.8 |
| Di-butyl ethers | 88.7 | 85.4 | 17.6 |
| Oligomers | 1.3 | 2.1 | 0.6 |

In comparison to the more acidic zeolites, alumina was less active and required higher temperatures to achieve equivalent conversions. High selectivities to the desired ethers can be obtained at moderate conversions.

TABLE 9

Results from 1-butanol dehydration over alumina (calcined)

| Temperature, ° F. | 482 | 482 | 572 |
|---|---|---|---|
| Pressure, psig | ~0 | ~0 | ~0 |
| LHSV, $hr^{-1}$ | 1.0 | 0.5 | 0.5 |
| 1-Butanol Conversion, % | 41.7 | 54.0 | 100 |
| Selectivity, wt. % | | | |
| 1-Butene | 24.0 | 24.8 | 80.5 |
| cis-2-Butene | 0.2 | 0.4 | 5.6 |
| trans-2-Butene | 0.5 | 0.4 | 13.8 |
| iso-Butene | 0 | 0 | 0.1 |
| Total Butenes | 24.7 | 25.6 | 100.0 |
| Di-butyl ethers | 74.8 | 74.2 | 0 |
| Oligomers | 0.5 | 0.2 | 0 |

Calcining the alumina prior to use increased its activity significantly, and good selectivities to ethers were obtained with low selectivities to oligomers.

Catalysts that can be used for 1-butanol dehydration to ethers are zeolites. Preferably they have less steric restrictions in the channel/cage system than with SSZ-32 (1D, 10-MR), facilitating the formation of di-butyl ethers which are much bulkier than butenes. Thus the preferred zeolites contain 12-ring or larger prores. Examples of such preferred zeolites are Y (3D, 12-MR), beta (3D, 12-MR) and SSZ-33 (3D, 12/10-MR).

It is preferred to have a lower reaction temperature and a higher reaction pressure to advantage the yield and selectivity to ethers over olefins.

EXAMPLE 3

Flow Micro Reactor Tests to Identify Catalysts Suitable for Conversion of Olefins into Alcohols and Ethers The flow-type microunits used in this study were equipped with a stainless steel fixed bed reactor and an on-line GC. The catalysts studied for 1-butene hydration are as follows: Alumina base from Condea Chemie, calcined in air at 950° F. for 4 hours, Zeolite Y (CBV 901, no binder), Zeolite Al-SSZ-33, Zeolite Al-SSZ-42, Amberlyst Resin XN-1010, Amberlyst Resin 15

The zeolite catalysts (0.24–0.26 g=4.0 cc each) were crushed to 24–60 mesh and, prior to the reaction, dehydrated in a $N_2$ flow (200 cc/min) at 662° F. (350° C.) overnight.

The products were analyzed with an on-line GC using a HP-1 capillary column and a FID as described above.

TABLE 10

Results of 1-butene hydration

| | Experiment | | | |
|---|---|---|---|---|
| | 1 | 2 | 3 | 4 |
| Catalyst | Al2O3 | Y | SSZ-33 | SSZ-33 |
| Temp., ° F. | 482–572 | 392 | 392 | 347 |
| Pressure, psig | 1500 | 250 | 1500 | 1500 |
| $H_2O$/1-Butene | 1.1–2 | 2 | 1.1 | 1.1 |
| LHSV, $hr^{-1}$ | 0.41–0.5 | 0.5 | 0.41 | 0.41 |
| 1-Butene = Conv. % | No Rxn | 3 | ~16 | 9.5 |
| Selectivities | | | | |
| Butanol | — | 100 | 62 | 84 |
| Ether | — | 0 | 38 | 16 |
| Oligomer | — | 0 | 0 | 0 |

| | Experiment | | | |
|---|---|---|---|---|
| | 5 | 6 | 7 | 8 |
| Catalyst | SSZ-42 | SSZ-42 | SSZ-42 | Amber. 15 |
| Temp., ° F. | 302 | 392 | 392 | 212 |
| Pressure, psig | 1500 | 1500 | 1500 | 1500 |
| $H_2O$/1-Butene | 1.1 | 1.1 | 12 | 12 |
| LHSV, $hr^{-1}$ | 0.41 | 0.41 | 0.41 | 0.5 |
| 1-Butene = Conv. % | 8 | 16 | 16 | ~50 |
| Selectivities | | | | |
| Butanol | 75 | 62 | 62 | 100 |
| Ether | 25 | 38 | 38 | 0 |
| Oligomer | 0 | Trace | 0 | 0 |

From these results, it can be concluded that the preferred catalysts for olefin hydration to form alcohols is a non-zeolitic catalyst such as a resin. By selection of the appropriate conditions, conversions of light olefins in excess of 50% can be obtained with selectivities to alcohols in excess of 80%, preferably in excess of 90%. Conditions which maximize the selectivity to alcohols include an effective ratio of water to olefin in excess of 2 preferably in excess of 5 and most preferably in excess of 10. Pressures should be as high as possible, preferably in excess of 250 psig, and most preferably in excess of 1250 psig.

If ethers are the desired product from a single-step reaction either a resin catalyst or a zeolite can be used. The preferred zeolites have as high of an acid strength as possible and contain 12-ring pores. High acid strength is obtained by having a $SiO_2/Al_2O_3$ molar ratio in excess of 4 preferably in excess of 10, more preferably in excess of 20, and even more preferably in excess of 40. The effective ratio of water to olefin should be between 0.1 and 3.

While the invention has been described with preferred embodiments, it is to be understood that variations and modification may be resorted to as will be apparent to those skilled in the art. Such variations and modifications are to be considered within the purview and the scope of the claims appended hereto.

What is claimed is:

1. A process for preparing a middle distillate fuel composition comprising the steps of:

(a) reacting a synthesis gas in a Fischer-Tropsch reactor and recovering a naphtha effluent containing olefins and alcohols and a heavy product;

(b) reacting the naphtha effluent in the presence of an acid catalyst to prepare a product containing at least one dialkylether;

(c) separating the product from step (b) into a component containing ether and a component containing naphtha that is depleted of olefins and alcohols;

(d) subjecting the heavy product to hydrotreating and/or hydrocracking to provide a naphtha and a distillate fuel component having an isoparaffinic content of at least 70 wt. %;

(e) blending the distillate fuel component from step (d) with from about 1% to 25% by weight of the component containing ether from step (c); and (f) recovering a middle distillate fuel composition.

2. A process according to claim 1 further comprising the step of mixing the naphtha effluent with water to provide a mixture, prior to reacting in the presence of an acid catalyst.

3. A process according to claim 1 further comprising the step of obtaining the synthesis gas from a natural gas methane stream, a petroleum fraction, coal or shale.

4. A process according to claim 1 further comprising the step of combining the component containing naphtha from step (c) with the naphtha from step (d).

5. A process according to claim 1 further comprising the steps of adding additional olefins to the component containing naphtha from step (c) to provide a mixture and feeding the mixture to an alcohol synthesis reactor to hydrate the olefins contained in the mixture.

6. A process according to claim 1 further comprising the step of hydrotreating the component containing naphtha of step (c) to remove any remaining alcohols and olefins, providing a hydrotreated naphtha.

7. A process according to claim 6 further comprising the step of reforming the hydrotreated naphtha to provide an aromatic-rich naphtha.

8. A process according to claim 6 further comprising the step of dehydrogenating the hydrotreated naphtha to form mono-olefins and diolefins.

9. A process according to claim 1 further comprising the steps of recovering a raw middle distillate fuel in addition to the naphtha effluent and the heavy product in step (a); hydrotreating and hydrodewaxing the raw middle distillate fuel to provide an effluent; and separating the effluent into a heavy product, an isoparaffinic distillate fuel component and a naphtha that is depleted of olefins and alcohols.

10. A process according to claim 2 further comprising the step of separating water in the component containing naphtha from the naphtha.

11. A process according to claim 2, wherein the effective ratio of water to olefin in the mixture is about 0.1 to about 3.

12. A process according to claim 1, wherein the acid catalyst is selected from the group consisting of zeolites, resins, clays, silica-alumina, and combinations thereof.

13. A process according to claim 8 further comprising the steps of hydrogenating the diolefins to mono-olefins and blending the mono-olefins with the naphtha effluent of step (a).

14. A process according to claim 1 further comprising blending a raw middle distillate fuel recovered in addition to the naphtha effluent and the heavy product in step (a) with the distillate fuel component of step (d) before blending the distillate fuel component with the component containing ether in step (e).

15. A middle distillate fuel made by the process of claim 1.

* * * * *